US008739705B2

(12) United States Patent
Rezaei et al.

(10) Patent No.: US 8,739,705 B2
(45) Date of Patent: Jun. 3, 2014

(54) AUTORACK RAILROAD CAR AND UNDERFRAME THEREFOR

(75) Inventors: Davood Rezaei, Calgary (CA); James W. Forbes, Campbellville (CA); Jamal Hematian, Burlington (CA)

(73) Assignee: National Steel Car Limited, Hamilton, Ontario (CA)

( * ) Notice: Subject to any disclaimer, the term of this patent is extended or adjusted under 35 U.S.C. 154(b) by 174 days.

(21) Appl. No.: 13/440,672

(22) Filed: Apr. 5, 2012

(65) Prior Publication Data

US 2013/0263757 A1 Oct. 10, 2013

(51) Int. Cl.
*B61D 3/00* (2006.01)

(52) U.S. Cl.
USPC ..... 105/413; 105/355

(58) Field of Classification Search
USPC ..... 105/355, 413, 414, 415, 416, 417, 418
See application file for complete search history.

(56) References Cited

U.S. PATENT DOCUMENTS

| | | | |
|---|---|---|---|
| 1,083,831 | A | 1/1914 | Holdaway et al. |
| 1,229,374 | A | 6/1917 | Youngblood |
| 1,460,991 | A | 7/1923 | Van Alstyne |
| 1,514,211 | A | 11/1924 | Hester |
| 1,894,534 | A | 1/1933 | Dolan |
| 2,009,149 | A | 7/1935 | Pierce |
| 2,659,318 | A | 11/1953 | Steins et al. |
| 2,801,597 | A | 8/1957 | Ecoff |
| 2,929,339 | A | 3/1960 | Schueder |
| 2,959,262 | A | 11/1960 | Parker et al. |
| 3,017,840 | A | 1/1962 | Fairweather |
| 3,173,382 | A | 3/1965 | Ryan |
| 3,205,836 | A | 9/1965 | Wojcikowski |
| 3,221,669 | A | 12/1965 | Baker et al. |
| 3,230,900 | A | 1/1966 | Ruprecht et al. |

(Continued)

FOREIGN PATENT DOCUMENTS

FR 1095600 A 6/1955

OTHER PUBLICATIONS

Association of American Railroads Advisory Committee; The Car and Locomotive Cyclopedia of American Practices; 1980; pp. 235-236, 238-255, 262-263, 266, 275; Fourth Edition; Simmons-Boardman Publishing Corporation, 1809 Capitol Avenue, Omaha, Nebraska 68102, US.

(Continued)

*Primary Examiner* — Jason C Smith
(74) *Attorney, Agent, or Firm* — Hahn Loeser & Parks LLP

(57) ABSTRACT

An autorack railroad car has an underframe that, in contrast to the prior art, has a straight-through center sill that is shallower, and of diminished geometry-based sectional properties generally, in the middle portion between the trucks than at the end portions at either the draft sills at the draft gear or at the truck centers. The bottom flange of the center sill is carried at a constant height from end to end, and is free of kinks in elevation. In the mid-span portion of the car, from truck center to truck center, the center sill is shallower in section than the side sills. The bottom flange of the center sill is carried at a height that corresponds to, or is higher than, the height of the lower flanges of the side sills, such that the cross-bearer arms are shallow, and the bottom flanges of the cross-bearer arms are substantially level.

21 Claims, 15 Drawing Sheets

(56) References Cited

U.S. PATENT DOCUMENTS

| | | | | |
|---|---|---|---|---|
| 3,240,167 | A | 3/1966 | De Podesta et al. | |
| 3,370,552 | A | 2/1968 | De Podesta et al. | |
| 3,426,704 | A | 2/1969 | Blunden | |
| 3,547,049 | A | 12/1970 | Sanders | |
| 3,927,621 | A | 12/1975 | Skeltis et al. | |
| 3,995,563 | A | 12/1976 | Blunden | |
| 3,996,860 | A | 12/1976 | Ravani et al. | |
| 4,077,330 | A | 3/1978 | Peisner et al. | |
| 4,119,042 | A | 10/1978 | Naves et al. | |
| 4,119,043 | A | 10/1978 | Naves et al. | |
| 4,149,472 | A | 4/1979 | Naves et al. | |
| 4,248,557 | A | 2/1981 | Roldness et al. | |
| 4,252,482 | A | 2/1981 | Naves | |
| 4,287,833 | A | 9/1981 | Roldness et al. | |
| 4,317,415 | A | 3/1982 | Galasan et al. | |
| 4,318,349 | A | 3/1982 | Galasan | |
| 4,730,562 | A | 3/1988 | Baker et al. | |
| 4,751,883 | A | 6/1988 | Bealer | |
| 4,759,669 | A | 7/1988 | Robertson et al. | |
| 4,924,780 | A | 5/1990 | Hart | |
| 4,936,227 | A | 6/1990 | Baker et al. | |
| 4,944,234 | A | 7/1990 | Hesch | |
| 4,964,347 | A | 10/1990 | Long et al. | |
| 5,320,046 | A | 6/1994 | Hesch | |
| 5,392,717 | A | 2/1995 | Hesch et al. | |
| 5,579,697 | A | 12/1996 | Burke | |
| 5,657,698 | A | 8/1997 | Black, Jr. et al. | |
| 5,701,825 | A | 12/1997 | Peach, Jr. | |
| 5,743,192 | A | 4/1998 | Saxton et al. | |
| 5,765,486 | A | 6/1998 | Black, Jr. et al. | |
| 5,832,836 | A | 11/1998 | Ehrlich et al. | |
| 5,845,584 | A | 12/1998 | Bullock et al. | |
| 6,138,579 | A | 10/2000 | Khattab | |
| 6,205,932 | B1 | 3/2001 | Khattab | |
| 6,244,801 | B1 | 6/2001 | Klag | |
| 6,273,004 | B1 | 8/2001 | Klag | |
| 6,283,040 | B1 | 9/2001 | Lewin | |
| 6,368,035 | B1 | 4/2002 | Recupido et al. | |
| 6,446,561 | B1 | 9/2002 | Khattab | |
| 6,550,400 | B1 | 4/2003 | Forbes | |
| 6,551,039 | B1 | 4/2003 | Forbes | |
| 6,659,016 | B2 | 12/2003 | Forbes | |
| 6,821,065 | B2 * | 11/2004 | Forbes | 410/26 |
| 6,845,722 | B2 | 1/2005 | Forbes | |
| 6,895,866 | B2 | 5/2005 | Forbes | |
| 6,935,245 | B2 | 8/2005 | Schorr et al. | |
| 7,047,889 | B2 | 5/2006 | Forbes | |
| 7,401,559 | B2 | 7/2008 | Dawson et al. | |
| 7,546,808 | B2 * | 6/2009 | Saxton et al. | 105/355 |
| 7,631,603 | B2 | 12/2009 | Forbes et al. | |
| 7,637,217 | B2 | 12/2009 | Barry | |
| 8,302,538 | B2 * | 11/2012 | Cencer et al. | 105/355 |
| 8,371,236 | B2 | 2/2013 | Budnick | |
| 2002/0073884 | A1 * | 6/2002 | Al-Kaabi et al. | 105/355 |
| 2002/0170459 | A1 * | 11/2002 | Beers | 105/355 |
| 2003/0200895 | A1 * | 10/2003 | Forbes et al. | 105/355 |
| 2003/0221582 | A1 * | 12/2003 | Burke et al. | 105/355 |
| 2004/0016362 | A1 * | 1/2004 | Cencer et al. | 105/355 |
| 2004/0173118 | A1 * | 9/2004 | Forbes | 105/355 |
| 2004/0173119 | A1 * | 9/2004 | Norton et al. | 105/355 |
| 2004/0250725 | A9 * | 12/2004 | Forbes | 105/355 |
| 2005/0045061 | A1 * | 3/2005 | Clark et al. | 105/355 |
| 2005/0087095 | A1 * | 4/2005 | Barry et al. | 105/355 |
| 2005/0126426 | A1 * | 6/2005 | Forbes | 105/355 |
| 2006/0016367 | A1 * | 1/2006 | Forbes | 105/197.05 |
| 2006/0070548 | A1 * | 4/2006 | Seiter | 105/355 |
| 2006/0117985 | A1 | 6/2006 | Forbes et al. | |
| 2006/0254457 | A1 * | 11/2006 | Forbes | 105/355 |
| 2007/0227395 | A1 * | 10/2007 | Zaerr | 105/355 |
| 2007/0295239 | A1 * | 12/2007 | Saxton et al. | 105/355 |
| 2008/0060544 | A1 * | 3/2008 | Kawasaki et al. | 105/355 |
| 2009/0241799 | A1 * | 10/2009 | Saxton et al. | 105/413 |
| 2009/0320716 | A1 * | 12/2009 | Forbes | 105/355 |
| 2010/0258031 | A1 * | 10/2010 | Forbes | 105/355 |
| 2010/0275812 | A1 * | 11/2010 | Forbes et al. | 105/406.1 |
| 2013/0263757 | A1 * | 10/2013 | Rezaei et al. | 105/355 |

OTHER PUBLICATIONS

Association of American Railroads Advisory Committee; The Car and Locomotive Cyclopedia of American Practices; 1997; pp. xiii, 7-13, 20, 24; Sixth Edition; Simmons-Boardman Books, Inc., 1809 Capitol Avenue, Omaha, Nebraska 68102, US.

* cited by examiner

AUTORACK RAILROAD CAR AND UNDERFRAME THEREFOR

FIELD OF THE INVENTION

This invention relates to the field of railroad freight cars, and, in particular to the field of railroad freight cars for carrying automotive vehicles, this kind of car being referred to in the industry as an "autorack" car.

BACKGROUND

Modern autorack cars, which is to say autorack cars built since about 1980, have typically had the structure of a flat car underframe covered by a surface deck for supporting automotive vehicles. Since automobiles are, overall, very low density lading as compared to commodities such as coal, sand and gravel aggregate, grain or ores, the flat car underframes tend to be limited by allowable truck center spacing, rather than by the gross weight on rail limit. Currently, autorack cars are typically 89 or 90 ft long as measured over the strikers and as much as 66 ft between truck centers.

The autorack car underframes carry a housing that may tend to resemble a barn. This superstructure is typically referred to as the "rack" of the autorack. In earlier eras the racks were open. However, open racks invite theft and vandalism. Thus modern autorack cars include full side panels (which may have perforations to permit ventilation) and fully closing end doors, with the intention of discouraging thieves and vandals. Most typically the housing structure includes a series of vertical posts spaced along the sides of the car, and one or two additional decks spaced upwardly from the main deck, and upon which respective second and third layers of automotive vehicles may be transported. That is, the rack may be a bi-level rack (i.e., a single elevated deck spaced upwardly above the main deck of the underframe) or a tri-level rack (two upper decks rather than one). These decks are carried on some kind of framework of sideposts spaced along the car, with diagonal bracing or shear web panels between the posts, as may be. The cars tend to be as tall as permitted under AAR Plate 'F', namely 20'-2" maximum height above Top of Rail (TOR). This housing may tend to have gable ends, those ends being open to permit circus loading of the cars, i.e., sequential loading of the automotive vehicles by driving in one end, and out the other on arrival. Although other kinds of doors are known, most typically radial arm doors are mounted at the gable ends and are movable between open and closed positions to govern loading and unloading of the cars. In at least one version of autorack, used for delivering highway tractors to market, there are no additional elevated decks. The racks are typically replaced twice during the economic life of the autorack car underframe. That is, the old set of racks is removed from the underframe and replaced with a new set of racks.

The underframe traditionally provides resistance to vertical bending. Given the great length of span between the truck centers, the center sills of autorack car bodies have tended to be "fish bellied". That is, the center sill is relatively shallow at the ends of the car at or adjacent to the centerplates over the trucks (i.e., at the truck centers), and rather deeper in the middle between the trucks, perhaps with a downwardly bent, or curved, or deviated, bottom flange. A fish-belly center sill is therefore a fabricated sill in which the bottom profile of the center sill webs is not level, but rather defines the profile of the depth of the beam as a function of longitudinal position. The bottom flange, or bottom cover plate of the center sill is not flat and level, but rather follows the fish-belly profile. The bottom flange may be formed of sections of plate welded to the webs and butt-welded end to end. The sections of the bottom flange may not be co-planar. That is, the fish-belly causes a vertical slope discontinuity. Where there is an abrupt change in properties in the flange, there may also be a corresponding discontinuity in the stress field. In the general case, the predominant loading modes in the bottom flange are (i) longitudinal tension induced by bending, and (ii) longitudinal tension or compression induced by buff and draft loads.

The inside width of section of the center sill is typically 12-⅞ inches. The depth over the centerplates, (i.e., corresponding to the depth of a standard draft sill) is typically 12-16 inches. The depth in the fish-belly is typically about 22 inches, more or less, at the mid-span location between the trucks and along much of the distance along that span between the trucks. A conventional autorack center sill may thus tend to be rather heavy and deep.

SUMMARY OF THE INVENTION

In a first aspect of the invention there is an autorack railroad car. It has an underframe structure that includes a center sill. The center sill has a first end and a second end. There is a first deck for transporting automotive vehicles. The first deck is supported by the center sill. There is a first centerplate located closer to the first end of the center sill than to the second end thereof. There is a second centerplate located closer to the second end of the center sill than to the first end thereof. The first centerplate is seatable at a truck center of a first truck. The second center plate is seatable at a truck center of a second truck. The center sill runs continuously from the first centerplate to the second centerplate. The center sill has a first location, the first location being a mid-span location midway between the first and second center plates. The center sill has a first depth of section at the mid-span location. The center sill has a second depth of section at a second location away from mid-span location. The second depth of section is greater than is the first depth of section.

In a feature of that aspect of the invention, the center sill has a greater second moment of area in bending at the second location than at the first location. In another feature, the center sill includes a draft sill portion, the second depth of section is measured at the draft sill portion; and the first depth of section is less than ⅔ of the second depth of section. In a further feature, the center sill has a depth of section at the first location of not more than 12 inches. In still another feature, the center sill has a depth of section at the first location of not more than 8 inches. In still another feature, the center sill has a truck center distance of not less than sixty feet.

In yet another feature, the center sill has a top cover plate, a bottom flange, and at least one shear web extending therebetween; and at least one of (a) when the car is unladen, the bottom flange is substantially flat and horizontal over substantially the entire distance between truck centers; (b) the top flange at the first location is closer to TOR than at the second location; and (c) at least one of the shear webs is shallower at the first location than at the second location. In a further feature, the center sill satisfies any permutation, including all of, of (a), (b) and (c).

In still another feature, at the first location the underframe has a second moment of area in vertical bending less than 4000 $in^4$. In another feature, at the first location the center sill has a second moment of area of less than 750 $in^4$. In a further feature, the second moment of area of the center sill at the first location is less than 400 $in^4$. In another feature, the autorack car has first and second side sills running along respective first and second laterally outboard margins of the deck, the center sill has a top flange, a bottom flange, and first and second webs extending between the top flange and the bottom flange; and, at the first location at least one of: (a) the first side sill has a greater depth of section than the center sill; and (b) the first side sill has a lower flange and an upper flange, and, at the first location, the bottom flange of the center sill is carried at a height that is at least as high as the lower flange of the first side sill. In a further feature, the car includes a housing running lengthwise along the car parallel to the center sill and overspanning the deck. The housing has a first end and a second end. The housing has an accessway at one end thereof to permit the loading of vehicles. The housing includes a pair of first and second top chords upwardly distant from the deck. The autorack railroad car includes shear connections between the top chords and the underframe. In a still further feature, the top chords and the center sill co-operate to define a deep truss. The truss has a neutral axis. In bending due to vertical load the center sill lies below the neutral axis and the top chords lie above the neutral axis.

In another aspect of the invention there is an autorack railroad car underframe. It has a length-wise running straight-through center sill, with a span of at least 60 feet between truck centers. The center sill is free of a fish-belly bottom flange, and has at least one of: (a) a mid-span depth of section of less than 12 inches; (b) a mid-span second moment of area of less than 750 $in^4$; and (c) a mid-span cross-sectional area of less than 40 $in^2$.

In a feature thereof, the underframe has first and second side sills running lengthwise along opposite margins thereof. Each of the side sills has a respective mid-span cross-sectional area and a mid-span depth of section. The mid-span depth of section of each of the side sills is at least as great as the mid-span depth of section of the center sill. In another feature, the underframe includes a first deck structure upon which automotive vehicles may be conducted lengthwise over the underframe. The first deck structure has a roadway surface at one of the truck centers that is carried at a first height above TOR. The first deck structure has a roadway surface at mid-span that is carried at a second height above TOR. The second height is less than the first height. The center sill has a top flange, a bottom flange, and at least one shear web extending therebetween. The top flange is closer to the bottom flange at mid-span than at either truck center. In another feature, the bottom flange is maintained at a substantially constant height relative to TOR between the truck centers.

In another aspect of the invention there is an autorack railroad car body unit underframe. The underframe has a lengthwise running straight-through center sill running continuously from end to end of the car body unit. The center sill is carried by railroad car trucks in longitudinal rolling motion along railroad car tracks. The center sill has a first end and a second end. The center sill has a mid-span location mid-way between the first end and the second end. The center sill has a top flange, a bottom flange, and at least one shear web member extending therebetween. The center sill has a smaller depth of section at the mid-span location than at the first end.

In a feature of that aspect, the body unit underframe center sill top flange is carried at a lower height above Top of Rail at the mid-span location than at the first end. In another feature, the bottom flange is substantially flat from end to end of the center sill. In a further feature, the top flange is closer in height to the bottom flange at the mid-span location than at the first end, and, when the underframe is unladen, the bottom flange is no closer to Top of Rail at the mid-span location than at the first end.

In another aspect of the invention, there is an underframe for an autorack railroad car. The underframe has a straight-through center sill, a first side sill, and a second side sill, all running in the same direction, the center sill is between the side sills. The straight-through center sill has a first end and a second end. Decking extends between the center sill and the first side sill, and between the center sill and the second side sill, the decking providing a roadway along which to conduct lading. At least the first end of the straight-through center sill is a draft sill. The draft sill has a draft sill depth. The center sill has a mid-span portion mid-way between the first and second ends. The mid-span portion has a mid-span depth. The first side sill has a depth. At least one of: (a) the mid-span depth is less than the draft sill depth; (b) the mid-span depth is less than the side sill depth; (c) the draft sill depth is less than the side sill depth; and (d) the mid-span portion of the center sill has a bottom flange. The first side sill has a bottom flange. The bottom flange of the mid-span portion of the center sill is carried more distantly from Top of Rail than is the bottom flange of the first side sill.

In a further feature, the underframe conforms to any two of the foregoing (a), (b), (c) and (d). In a still further feature, the underframe has any three of (a), (b), (c) and (d). In a yet further feature the underframe has all of (a), (b), (c) and (d).

In still another aspect of the invention there is an autorack railroad car body. The car body has first and second ends. The car body has an underframe and a housing structure overspanning the underframe. The housing structure includes a longitudinally running array of posts mounted along lateral margins of the underframe, longitudinally running first and second top chords surmounting the posts, a roof structure extending upwardly of, and between, the first and second top chords, side wall panels mounted between pairs of the posts, the housing having at least a first end through which to permit lengthwise loading of vehicles. The underframe includes a center sill, and a pair of first and second side sills. The center sill and the side sills run lengthwise along the car body. The first side sill is spaced laterally to a first side of the center sill, the second side sill is spaced laterally to a second side of the center sill, the center sill being between the first and second side sills. The underframe has decking upon which vehicles can be conducted lengthwise along the car body. The decking extends between the center sill and the first side sill, and extends between the center sill and the second side sill. The center sill includes at least one draft sill portion adjacent one end of the car body, and a central portion. The central portion is located in a medial portion of the car away from the first end of the car body and away from the second end of the car body. Adjacent to the draft sill, the decking is carried at a first height relative to TOR. Adjacent to the central portion of the center sill the decking is carried at a second height relative to TOR. The first height is greater than the second height. The center sill has a first depth of section at the draft sill. The center sill has a second depth of section at the central portion thereof. The second depth of section is less than the first depth of section.

In another aspect of the invention there is a center sill for an autorack railroad car. The center sill has a top flange, a bottom flange, and first and second webs extending between the top flange and the bottom flange. The center sill has a first end, a second end, and a medial portion therebetween. The bottom flange is carried at a height relative to TOR. The height is constant over the length thereof. The center sill has a minimum depth of section, $h_m$, at a first longitudinal station in the medial portion thereof.

In a further feature, the center sill has at least one truck center, the center sill has a depth of section at the truck center, $h_{TC}$; and $h_m$ is less than $h_{TC}$. In another feature, the bottom flange of the center sill is free of slope discontinuities in elevation therealong. In still another feature, the medial portion of the center sill is of constant cross-sectional area. In still another feature, the center sill is combined with decking mounted to cooperate therewith and upon which longitudinally to conduct lading. The decking extends laterally of the center sill. The decking is carried at a first height at the first end of the center sill, and at a second height along the medial portion thereof. The second height is less than the first height, and, at the minimum depth of section, $h_m$, the top flange is carried at a height that is less than the first height of the decking. In a still further feature, the combination further includes a pair of longitudinally running laterally spaced apart first and second side sills. At the first longitudinal station, the first side sill has a depth of section that exceeds the depth of section $h_m$. In another feature, the first side sill has an upper flange and a lower flange, the lower flange is carried one of (a) flush with; and (b) lower than, the bottom flange of the center sill. In still another feature, the upper flange of the first side sill is carried higher than the decking. In yet another feature, the upper flange of the first side sill is carried higher than the top flange of the center sill over the medial portion thereof.

In another aspect of the invention there is a center sill for an autorack railroad car. The center sill has a first end, a second end, and a medial portion between the first and second ends. The center sill has a top cover plate, a bottom cover plate, and a pair of first and second laterally spaced apart webs extending between the top cover plate and the bottom cover plate, the top cover plate and the bottom cover plate defining respective top and bottom flanges of the center sill. At least one of the first and second ends includes a draft sill. The draft sill has a maximum depth of section, $h_d$, at a first longitudinal station of the center sill. The medial portion has a minimum depth of section, $h_m$, at a second longitudinal station of the center sill distant from the first longitudinal station. At the first longitudinal station the top cover plate is carried at a first height, $h_1$ relative to TOR. At the second longitudinal station the top cover plate is carried at a second height, $h_2$, relative to TOR. $h_1$ is greater than $h_2$; and $h_d$ is greater than $h_m$.

In a feature of that aspect of the invention, the center sill has at least one truck center. At the first truck center the top cover plate is carried at a height, $h_{TC}$. $h_{TC}$ is greater than $h_m$; $h_d$ is greater than $h_{TC}$. In another feature, the bottom cover plate of the center sill is free of slope discontinuities in elevation. In still another feature, the bottom cover plate is planar from end to end longitudinally. In still another feature, the bottom flange of the center sill is carried at a constant height, $h_{BF}$, throughout its length.

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
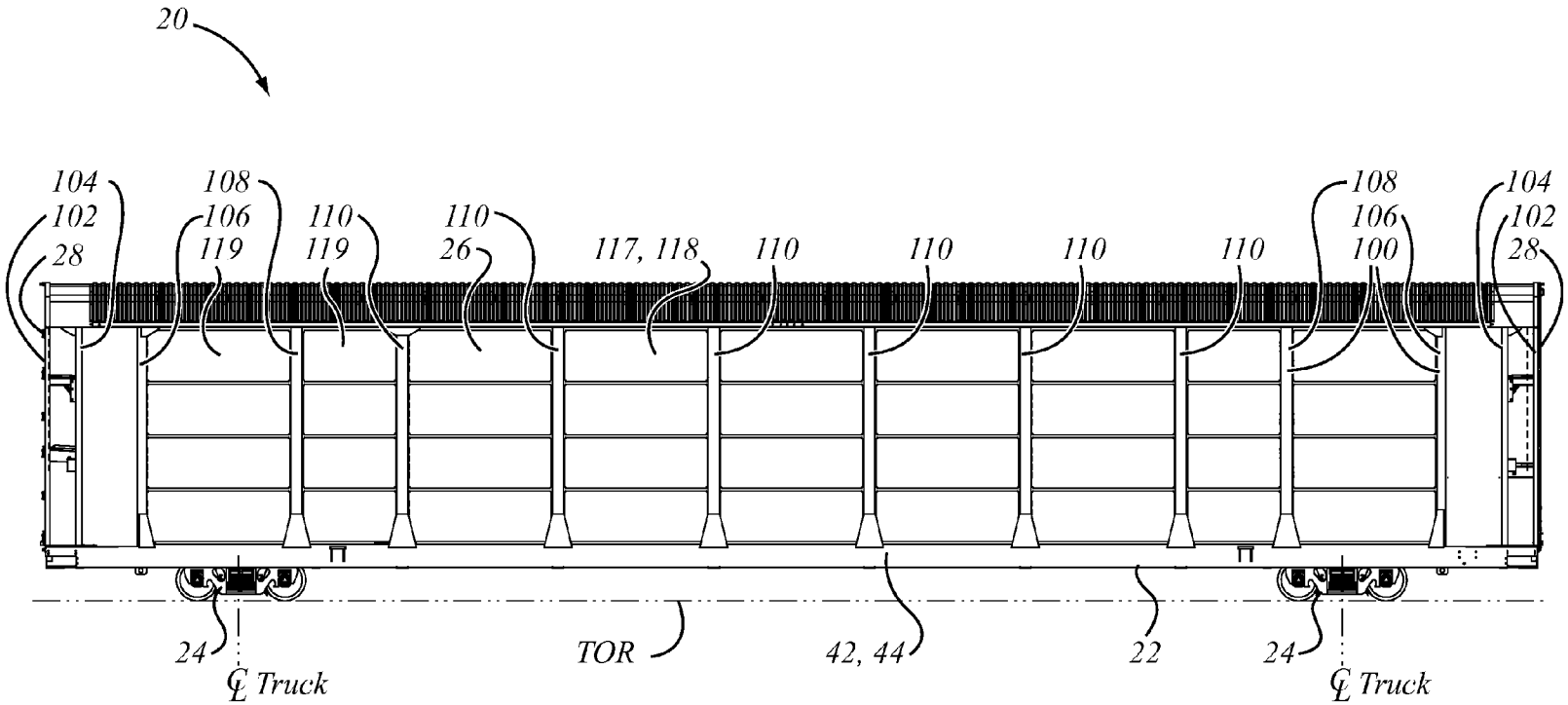
FIG. 1*a* is a general arrangement, side view of an autorack railroad car according to an aspect of the invention.
Figure 1B:
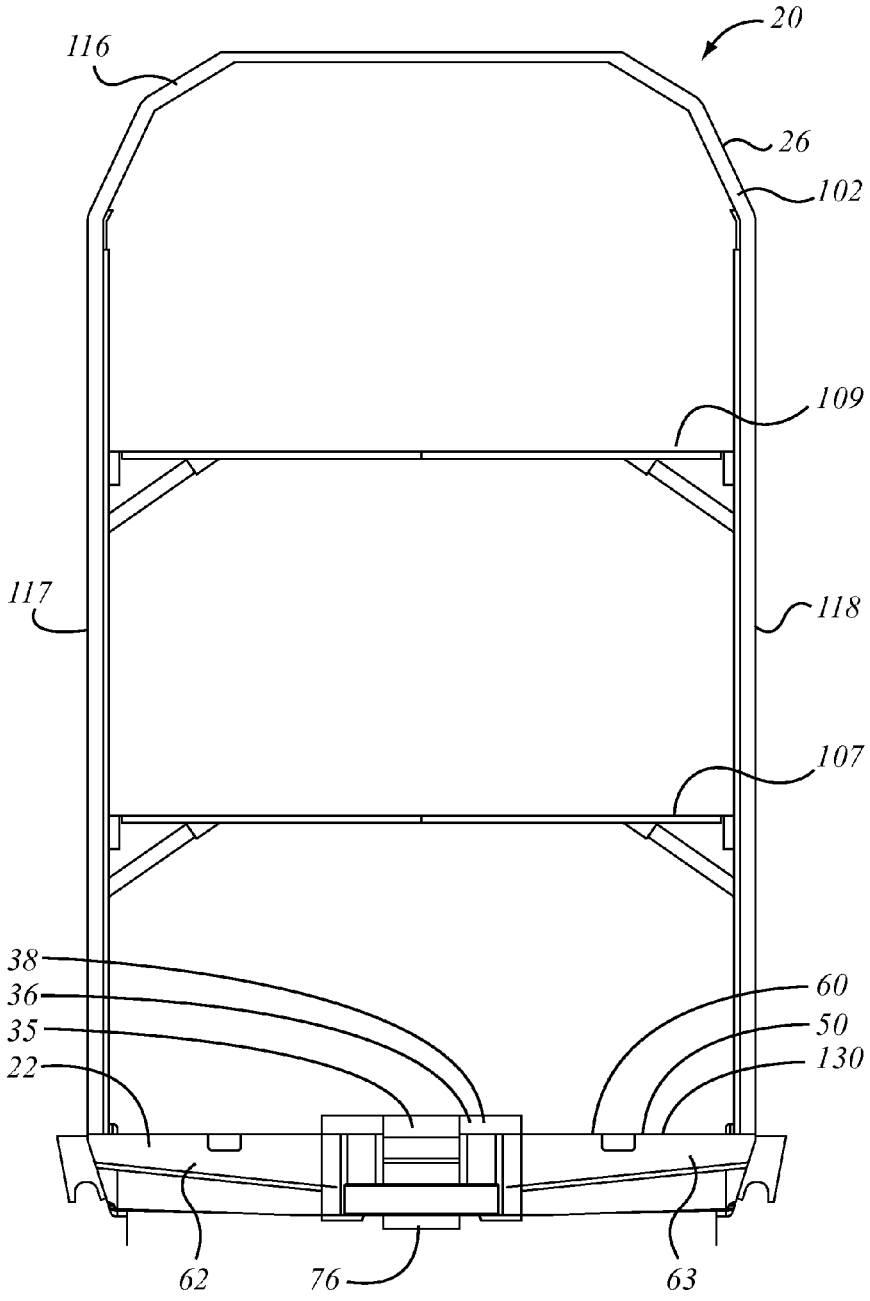
FIG. 1*b* is an end view of the autorack railroad car of FIG. 1*a*, without trucks, and with doors removed.
Figure 1C:
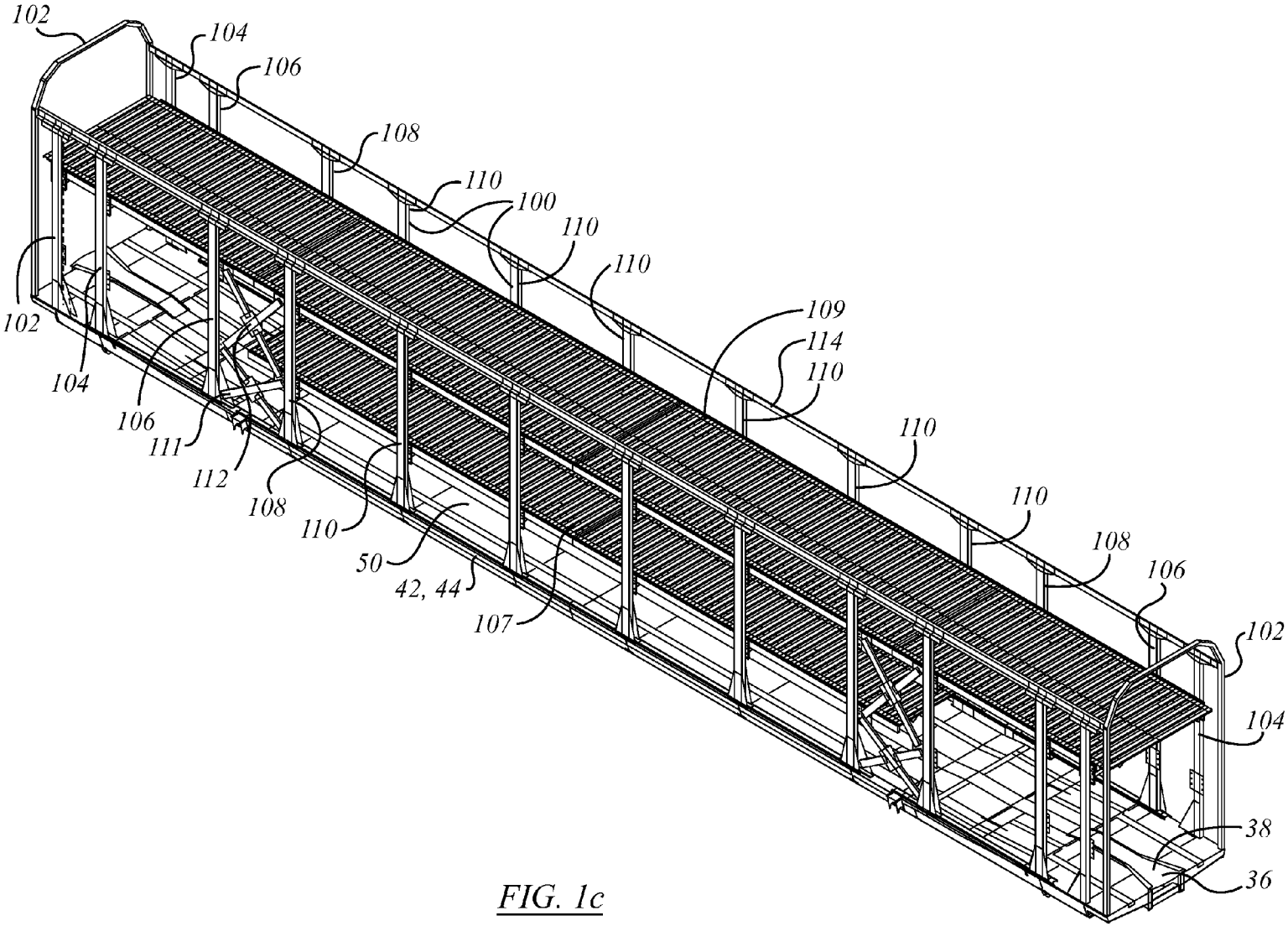
FIG. 1*c* is an isometric view of the autorack railroad freight car of FIG. 1*a* without trucks; with housing side panels and roof panels removed to show internal structure, and with the end portions of the mid-level deck removed.
Figure 1D:
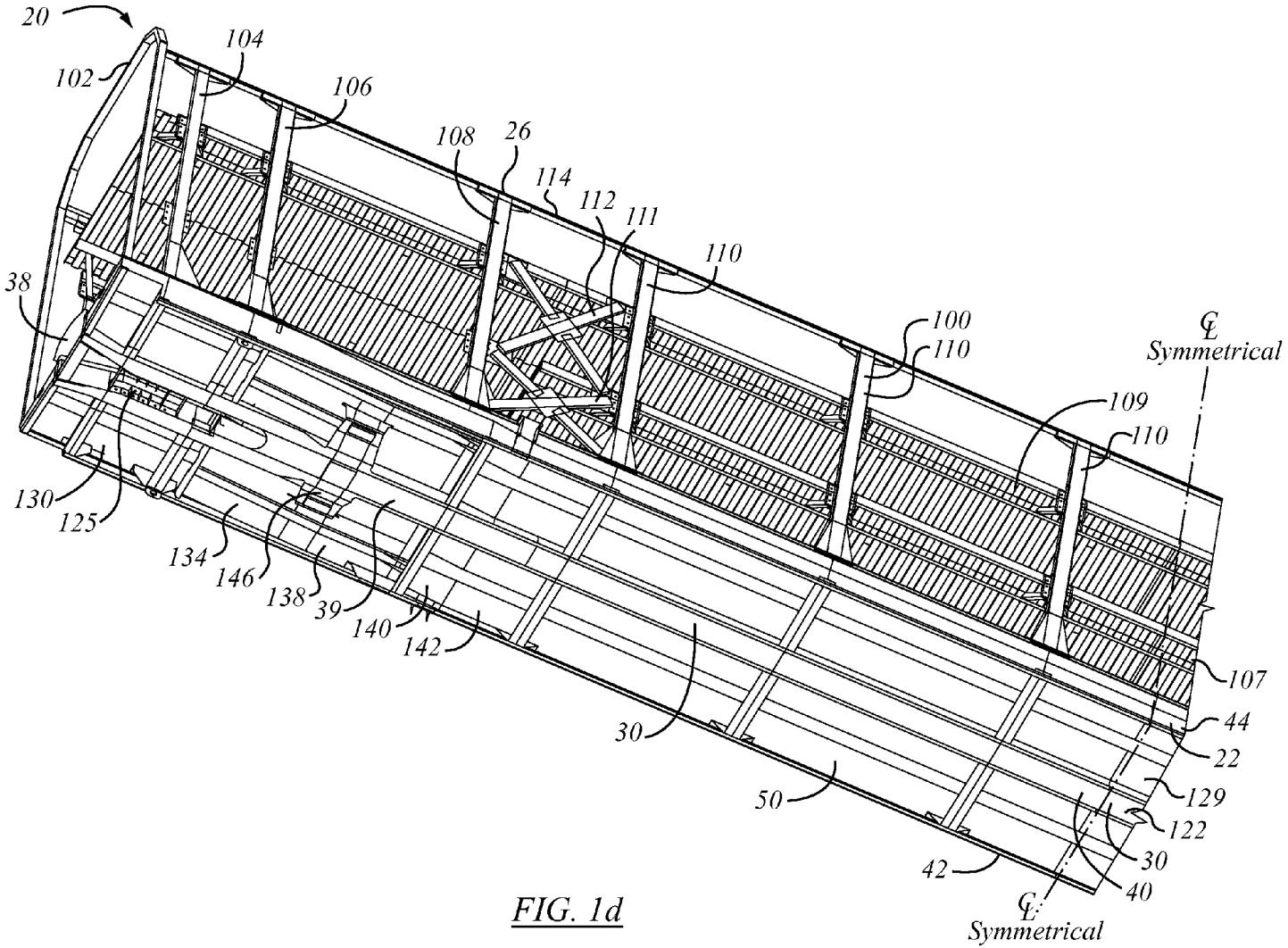
FIG. 1*d* is a perspective view, from below, of one half of the autorack railroad car structure of FIG. 1*c;*
Figure 2A:
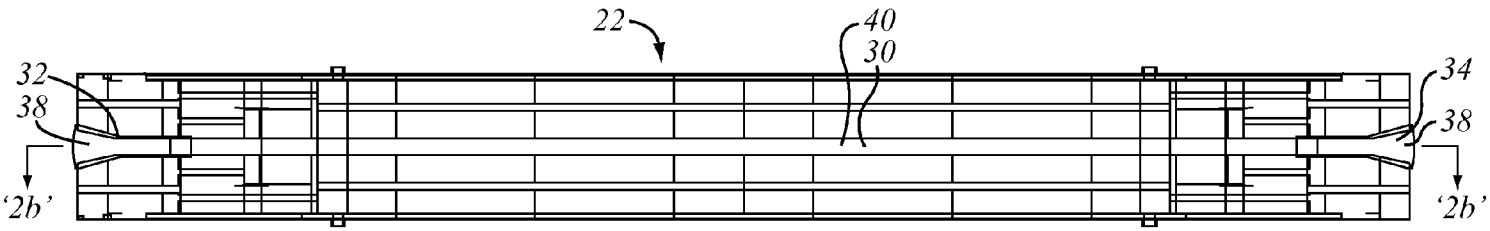
FIG. 2*a* is a top view of the under-frame of the autorack railroad car structure of FIG. 1*c;*
Figure 2B:
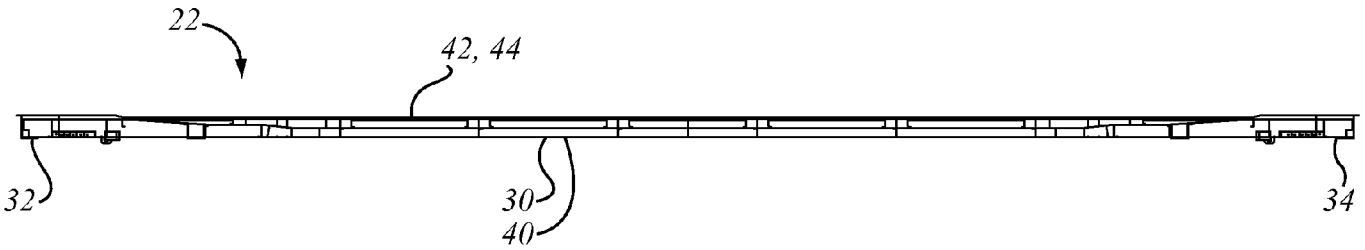
FIG. 2*b* is a side view of the underframe of the autorack railroad car of FIG. 2*a;*
Figure 2C:
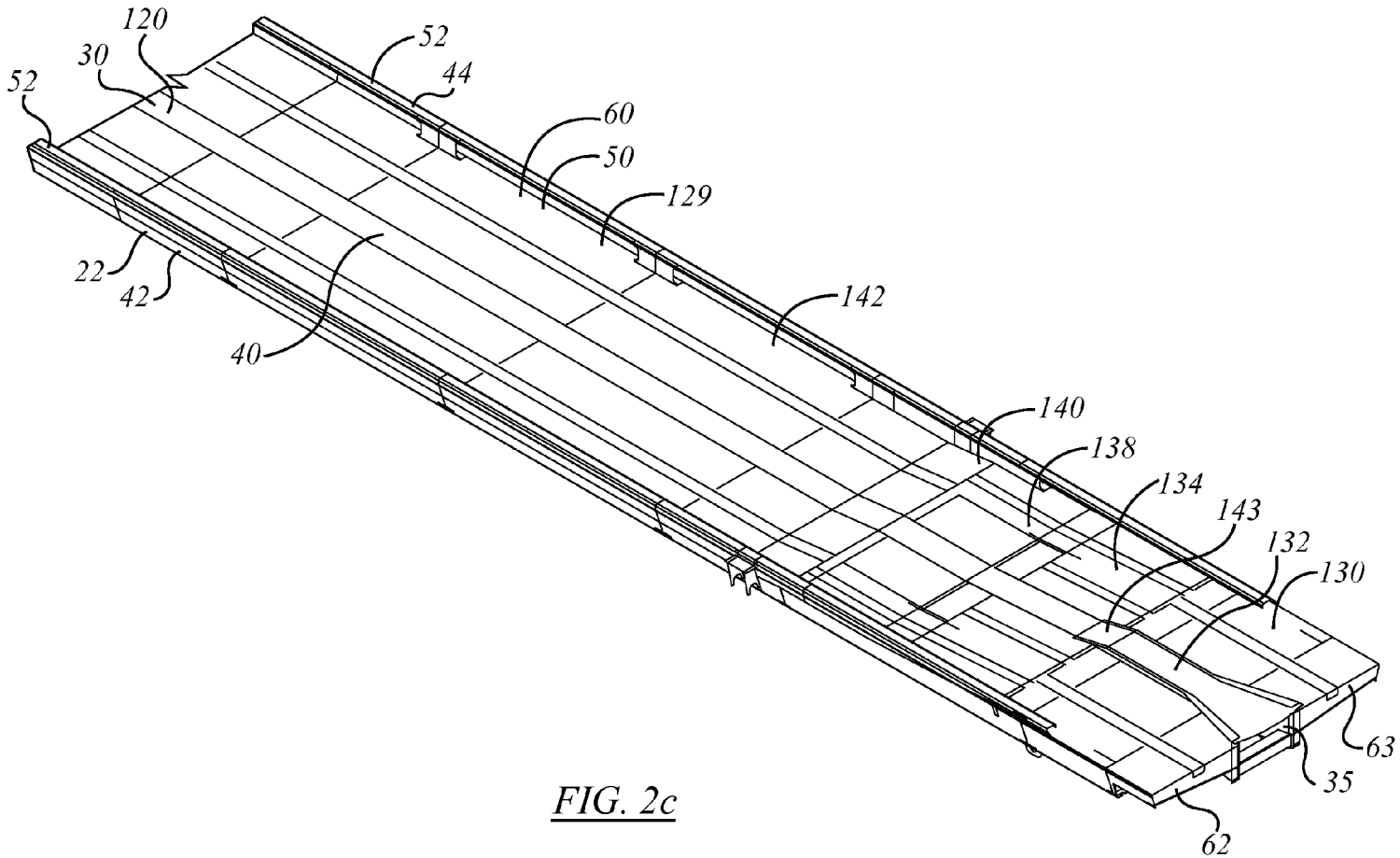
FIG. 2*c* is an isometric view of one half of the underframe of FIG. 2*a* on a view from one corner and above.
Figure 2D:
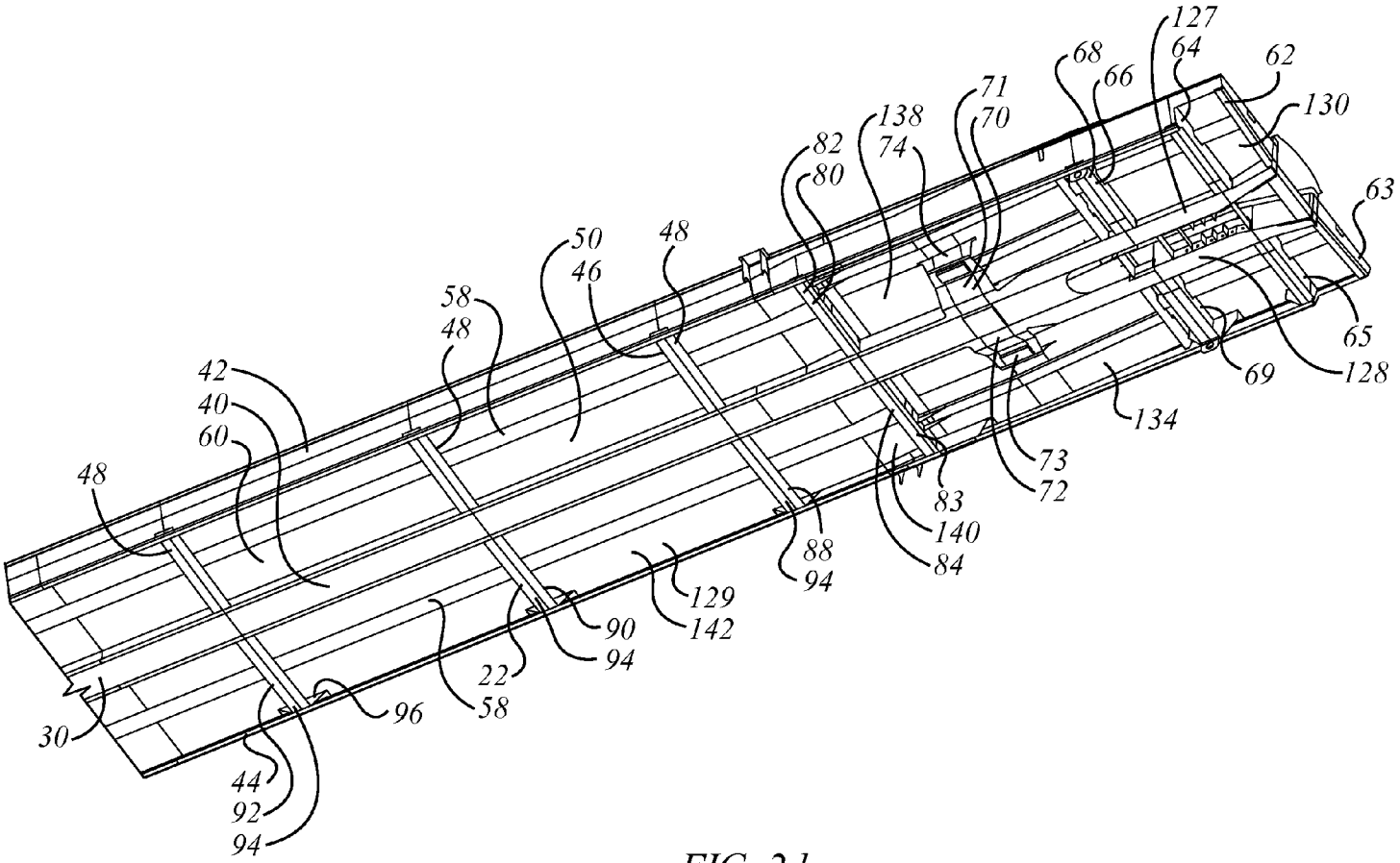
FIG. 2*d* is an isometric view of one half of the underframe of FIG. 2*a* on a view from one corner and below.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise. Where reference is made to a prior art structure, the prefix 'P' before an item number may be understood as identifying prior art elements corresponding to the item of the same number in a presently described embodiment. For example 122 may pertain to a center sill bottom flange or bottom cover plate. P122 then corresponds to the prior art center sill bottom flange or bottom cover plate.

The terminology used in this specification is thought to be consistent with the customary and ordinary meanings of those terms as they would be understood by a person of ordinary skill in the railroad industry in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the railroad industry in North America or in other former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal or y axis perpendicular to the longitudinal or x direction. Yawing is angular motion about a vertical or z axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, the abbreviation kpsi stands for thousands of pounds per square inch. To the extent that this specification or the accompanying illustrations may refer to standards of the Association of American Railroads (AAR), such as to AAR plate sizes, those references are to be understood as at the earliest date of priority to which this application is entitled.

It may by understood that persons of ordinary skill in the art are familiar with the Rules and Standards of the Association of American Railroads, which govern interchange service in North America. To the extent necessary or appropriate this specification is to be interpreted in a manner consistent with those Rules and Standards as they stood on the date of priority of the earliest application from which this application claims priority, if any, as if they formed part of this specification.

Also for the purposes of the present discussion, it may be taken as a default that the underframe structure of the car is of all welded mild steel fabrication except as otherwise shown in the illustrations or indicated in the text. This need not necessarily be the case. Other materials, such as aluminum or stainless steel might be used. The upper rack structure may also be taken as being of steel fabrication, although, again, aluminum or stainless steel might be used, and the side web panels of the car, which may be made of mild steel, stainless steel, or aluminum might also be made from plastic composite material, which may be reinforced composite.

In FIGS. 1*a*-1*d*, an autorack railroad car is shown generally as 20. It has an underframe, or underframe assembly, indicated generally as 22, that is carried upon railroad car trucks 24 for rolling motion in a longitudinal or lengthwise direction along railroad tracks. Underframe 22 is surmounted by an overspanning housing structure indicated generally as 26, and which may be referred to as "the rack" or "racks" of the car. The ends of housing structure 26 are open to permit loading and unloading of automotive vehicles. Ingress and egress of those vehicles is governed by a pair of end doors, 28, such as may be radial arm doors movable between open and closed positions.

Underframe 22 has a centersill 30. Center sill 30 is a "straight through" center sill that runs substantially entire length of the car between first and second ends 32, 34 at which strikers 35 are mounted. The main deck 50 extends to either side of the center sill to the sides of the car at side sills 42, 44. The term "straight through" is used in distinction to stub center sills such as used in, e.g., grain cars, where the center sill at each end of the car is truncated inboard of the center plate to leave a "stub", namely the center plate and draft sill assembly. In a straight through center sill, the center sill extends from one truck center to the other. The outboard portions of the center sill may be identified as the draft sills 38 in which the draft gear and couplers are mounted. Draft sills 38 are extensions of center sill 30 that extend longitudinally outboard of (and often include) the truck center to the striker 35. Draft sills 38 may be cast assemblies to which the central portion 40 of center sill 30 is connected, as by welding. Alternatively, draft sills 38 may be fabricated structures that merge into the fabricated structure of central portion 40. Between each of the respective draft sills 38 and the central portion 40 of center sill 30 there may be a transition region, indicted as 39. In central portion 40, the bottom flange of the center sill is a single plate that forms a closed box section with the center sill webs and the center sill top cover plate. Outboard of the truck center the bottom flange bifurcates into two toes that extend laterally sideways of the center sill webs, leaving a space therebetween by which to admit installation of the draft gear in the draft pocket between the webs.

Side sills 42, 44 run lengthwise along either side of underframe assembly 22, and are structurally connected to center sill 30 by an array of laterally extending structural members 46 which may include cross-bearers 48 and cross-ties (not shown). A cross-bearer is a beam having a first end connected to the center sill at a connection that is intended to be capable of transmitting a bending moment, such that the cross-bearer is also a cantilever that has its root, or built-in end at the center sill. The second end or distal end or transversely outboard end of each cross-bearer is connected to the associated side sill running along that side of the car. The outboard connection may be a built-in connection or, perhaps more commonly, a connection that can be analyzed as a pin joint. A cross tie is a laterally extending beam member whose ends are analyzed as being simply supported pin connections that do not transmit vertical load bending moments. The ends of a cross-tie are typically at the center sill and the respective side sill. The side sills are themselves beams, typically of hollow or open section, formed with an upper flange, a lower flange, and a medial portion that functions as a web to carry shear between the upper and lower flanges. Side sills may sometimes have a somewhat C-shaped section, with the open part of the C facing toward the center sill and the webs of the cross-bearer and cross-ties extending into the C and forming a connection.

Main deck 50 typically extends across the car from side sill to side sill and from end to end of the car, and provides a driving pathway for wheeled vehicles, i.e., the lading for this kind of car. Main deck 50 is supported by side sills 42, 44, center sill 30, and cross-bearers 48 and such cross-ties as may be, and may form the top flange of one or more of them. In the example illustrated, for example, main deck 50 forms, or is substantially flush with the top cover plate (i.e., top flange) of center sill 30, over most or all of its length e.g., excluding draft sills 38. The main deck may also form the top flange of the cross-bearers 46 and cross-ties (if any). Main deck 50 may vary in elevation relative to Top of Rail, as described below, but, in general, may tend to meet side sills 42 and 44 at an intermediate height such that top flange 52 of each side sill stands upwardly thereof, and the inner face of the substantially upstanding web or wall 54 of the side sill defines the outboard edge of the deck. The main deck is open at the ends (i.e., the curbs defined by the side sills only run along the sides) such that wheeled vehicles may be end-loaded. Each side sill also has a bottom flange 56. The side sill outboard wall, or web 54 may be kinked or slanted, and defines a vertical shear transfer web between top flange 52 and bottom flange 56. The side sill may be of open section (e.g., as a formed C-channel or regular or irregular shape) or closed section (e.g., a closed box-section), but in either case wall 54 of the side sill functions as a shear web between top flange 52 and bottom flange 56. Main deck 50 may also have lengthwise-running stringers 58 located on the underside of main deck sheet 60 at the transverse location of the wheel trackways locally to reinforce those areas of the floor over which the vehicle wheels roll during loading and unloading of the railroad car, and which support the automobile lading during operation.

Looking at the underframe from underneath, the left hand and right hand end sill portions lying to either side of the bell-mouth 36 of draft sill 38 are indicated as 62, 63. The next longitudinally inboard left hand and right hand cross-members are shown as 64, 65. The next inboard cross-members, defining left hand and right hand portions of a first lateral frame 66 (that is interrupted by draft sill 38), are indicated as 68, 69. Further longitudinally inboard is the main bolster, 70. Main bolster 70 is a stub bolster having laterally extending left hand and right hand stubs or arms, 71, 72, each of which has a side bearing pad 73, backed up by a bolster end web 74 and foot load spreading pad mounted to the underside of main deck 50. The center plate 76 is mounted at the intersection of center sill 30 and main bolster 70. It may be noted that main bolster 70 has longitudinally outboard and longitudinally inboard webs 78, 79.

Still further inboard of main bolster 70 is a second lateral cross-member or cross-bearer, or frame 80 having left and right hand arms 82, 83 that extend between center sill transition region 39 and side sills 42, 44 respectively, there being an internal web (not shown) within transition section 39 providing web continuity across center sill 30. As can be seen, the bottom flanges 84 of arms 82, 83 may be flush, or substantially flush, with the bottom flange of center sill 30. Scab or backing plates may overlap the juncture between the frame flange and center sill flange junction, and may be welded all-around, this technique also being used at the first lateral frame and the first right and left hand cross-members, and elsewhere in the car.

Still further inboard, extending laterally from central portion 40 of center sill 30, is, or are, a further cross-member or cross members in the form of cross-bearers 88, 90, 92. There are internal webs (not shown) in central portion 40 providing lateral web continuity across center sill 30 of the webs of cross-bearers 88, 90, 92 respectively. Each of cross-bearers 88, 90, 92 has a bottom flange 94 that may be flush with the bottom cover plate (i.e., bottom flange) of center sill 30. At the outboard, or distal, ends, each of cross-bearers 88, 90, 92 has a load spreading web 96, and a web extension gusset 98. Load spreading web 96 extends along the side sill laterally of each cross-bearer, and extends substantially vertically between the toes of the side sill section, and forms a locally closed box-section therewith having web continuity above and below main deck 50 at those locations. Web extension gusset 98 provides web continuity in the plane of the web of each respective cross-bearer between extension gusset 98 and outer wall 54 of side sill 42 (or 44), in effect forming a structural knee in which gusset 98 has upper and lower flanges defined by main deck 50 and the cross-bearer flange 94, and laterally inboard and outboard flanges defined by members 54 and 96.

Looking at the framework of housing structure 26, housing structure 26 includes a series of posts 100. There is an end framing structure, indicated as 102, that extends upwardly from the ends of the end sill, and which defines the shape of the gable end. Next inboard is "the first post", an upright side post 104 that runs between the side sill and the top chord at the station of the first lateral cross-members. Next inboard are posts 106, mounted at the ends of the first lateral frame (i.e., outboard of the truck center), and posts 108, mounted at the ends of the second lateral frame member. Posts 110 are mounted further inboard at the ends of the respective cross-bearers 88, 90, 92 that extend laterally of central portion 40 of center sill 30. In the embodiment illustrated, there is no vertical post at the longitudinal station of main bolster 70. Diagonal shear bracing 111, 112 is mounted between posts 108 and next longitudinally inboard posts 110. Longitudinally running top chords 114 run along, and tie together, the tops of all of posts 104, 106, 108, 110 and so on, as may be. The roof structure 116 is mounted atop the top chords and restrains them in the lateral direction, and provide a lateral shear connection between the left and right hand side walls 117, 118 of the car. The roof structure includes a framework of lateral frames and longitudinal stringers (not shown). This framework and the stringer for a truss structure that cooperates with the truss structure of the sidewall posts. The framework may support one or more elevated decks, such as a second or mid-level deck 107, and a third or upper deck 109. The entire structure includes sidewall panels 119 that are mounted between the various posts, and that may tend to act as shear panels between those posts and between the side sills and the respective top chords.

Figure 3A:
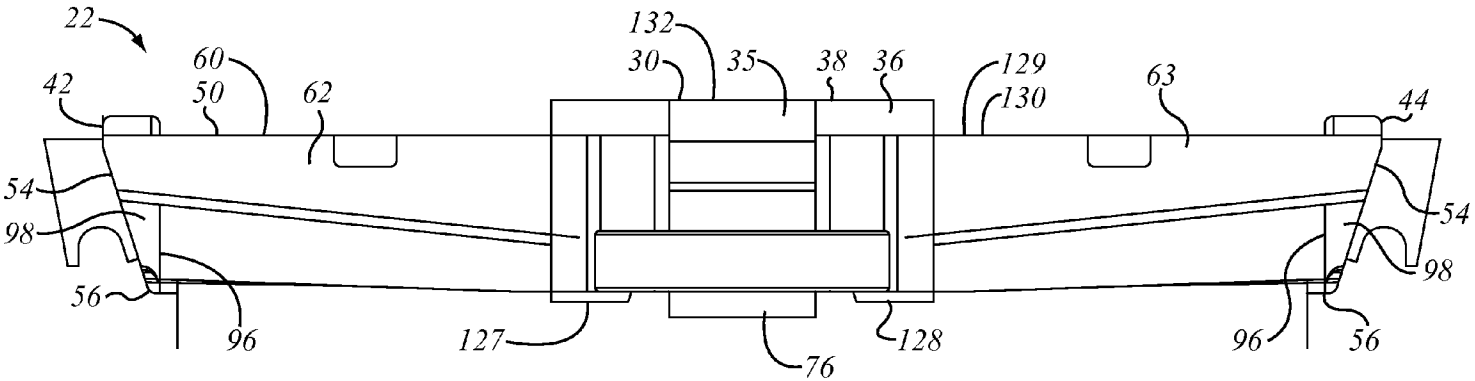
FIG. 3*a* is an end view of the underframe of FIG. 2*a;*
Figure 3B:
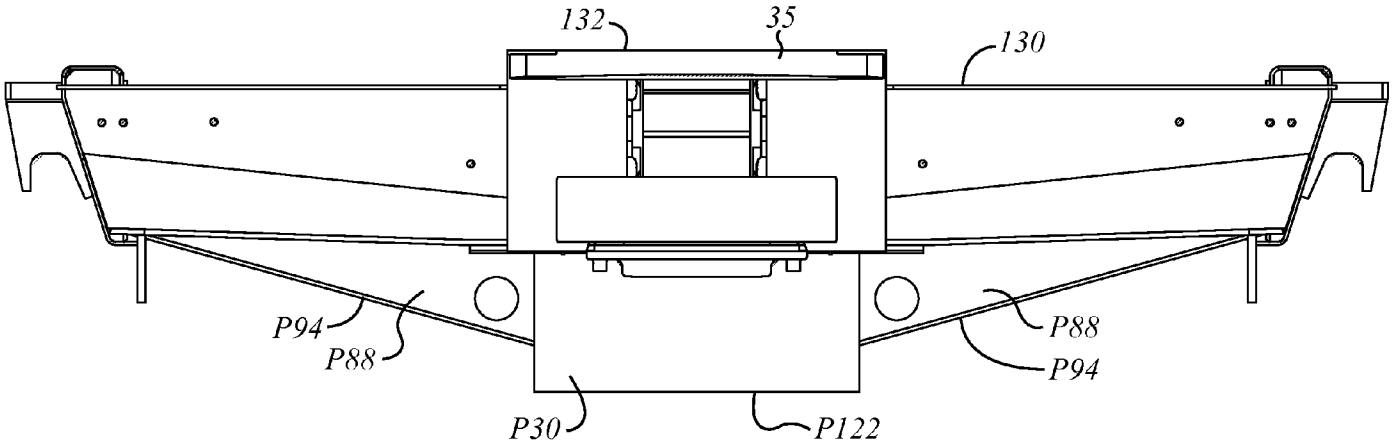
FIG. 3*b* is an end view of a prior art underframe in comparison to that of FIG. 3*a;*
Figure 3C:
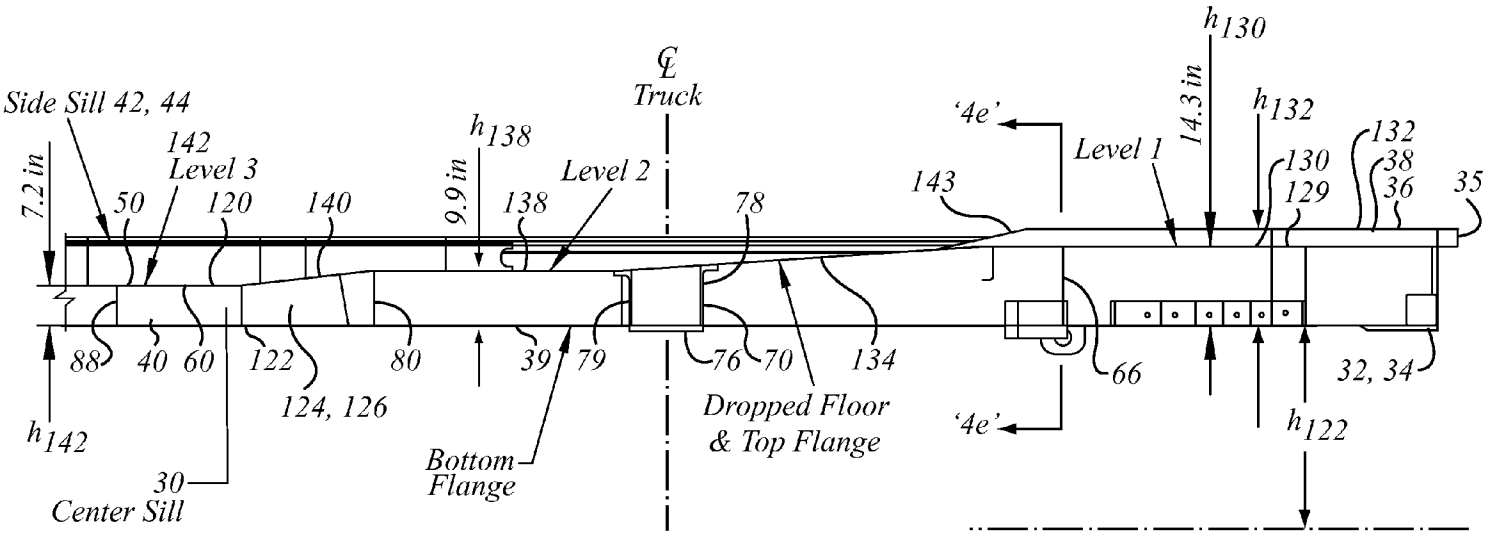
FIG. 3*c* is an enlarged partial side view of the underframe of FIG. 2*b;*

Center sill 30 has a cover plate, or top flange 120 (which, at some locations, as noted above, may be defined by main deck 50), a bottom cover plate or bottom flange 122, and left and right hand vertical shear webs 124, 126. Over the truck centers, center sill 30 has respective truck center plates 76 that seat in the corresponding center plate bowls of trucks 24. Draft sill 38 may be fabricated as a welded assembly, or it may be an integrally cast unit. For autorack cars with, typically, a large longitudinal overhang, the draft sill may tend to have a bell-mouth as indicated at 36. The draft sill typically terminates at its outboard end at a plate, that plate being striker 35. Inboard of striker 35 plate is a draft pocket, indicated generally as 125 into which are mounted front and rear draft stops, draft gear, a yoke, and a coupler. The bottom of the draft sill is open, with laterally outwardly extending flanges, or toes, as at 127, 128, the center being open to permit installation of the draft gear, and the flanges having mounting fittings for the coupler carrier plate in the usual manner. Longitudinally outboard of the center plate 76 the draft sill is, typically, AAR standard 12-⅞ inches wide between inside faces of the vertical shear webs at the draft gear, and typically 12 or more inches deep from the bottom surface of the bottom flanges to the top cover plate. For example, the depth of the draft sill at the bell mouth, $h_{132}$ as shown in FIG. 3*c* may be of the order of 17-½ to 18 inches. The bottom flanges of the draft sill are usually carried about 28-30 inches above TOR. As a reference datum, the coupler centerline height above Top of Rail for an unladen car with new wheels is 34-½ inches above TOR.

Figure 3D:
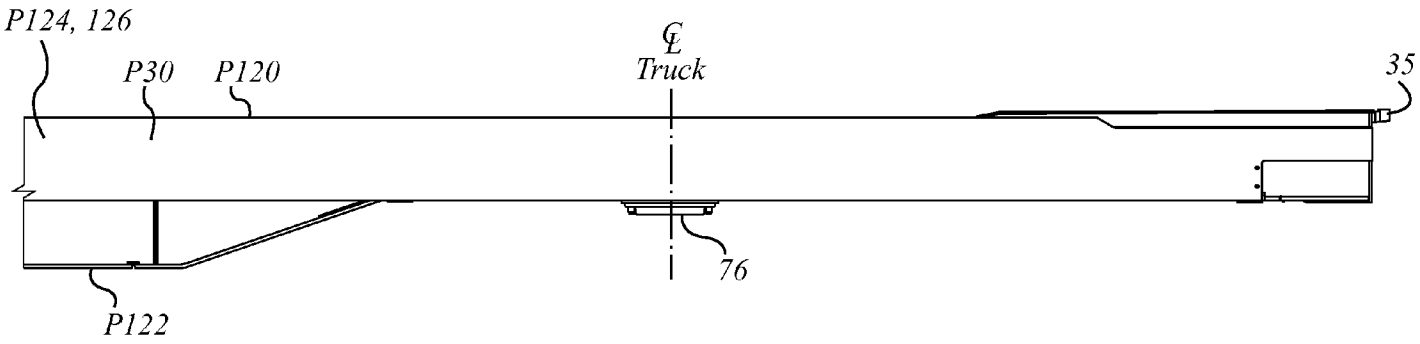
FIG. 3*d* is an enlarged partial side view of the prior art underframe of FIG. 3*b;*

As noted, longitudinally inboard of the respective center plates 76 lies the main or central portion 40 of center sill 30. Along this portion, which extends continuously to the far end of car 20, bottom flange 122 is substantially horizontal when viewed at any cross-section in the y-z plane, from a viewpoint looking along the center sill. Furthermore, as shown, bottom flange 122 is substantially horizontal and flat in the lengthwise direction. Further still, bottom flange 122 is carried at the same height, or substantially the same height relative to TOR from striker to striker, as is symbolized by the constancy of that height, $h_{122}$, in the various views. That is, as in the embodiment illustrated in FIG. 3*c*, and in contrast to the prior art embodiment illustrated in FIG. 3*d*, the height of the bottom flanges 127, 128 of draft sills 38 may be carried at the same height as the bottom cover plate 122 of center sill 30 at the truck centers, at the same height in the center sill transition zone 39 immediately longitudinally inboard of the truck centers, and at the same height in the central, mid-span portion 40 of center sill 30 longitudinally inboard of transition 39. Mid-span portion 40 may be of constant, or substantially constant, cross-section, as in the embodiment illustrated. It will be appreciated that center sill 30 may have a slight camber in its unladen condition, such that it may be flat and horizontal when the car is fully laden, or the center sill bottom cover plate 122 may vary slightly in height. However, such variation, if any, is small, of the order of 2" or less, as compared to the variation in a fish bellied sill. Expressed differently, even if bottom cover plate, or bottom flange, 122 is not perfectly level, it is free of upward and downward kinks, i.e., it is free of slope discontinuities in elevation.

For example, in a prior art fish-belly sill, in which the bottom flange is identified as P122 and the side webs are identified as P124, P126, the depth at mid-span may be 22 inches or more. (In center sill 30, in some embodiments the corresponding mid-span depth may be about 7,7-¼ or 7 ½ inches or so). Thus the mid-span eccentricity of the bottom cover plate in the prior art example of FIGS. 3*d* and 4*e*, may be roughly 10 inches (i.e., 22-12). In the embodiment illustrated, the eccentricity of the bottom cover plate may be considered as zero, and, in any case, less than ¼, and more probably less than 1/10, of the customary eccentricity of the prior art sill. Expressed differently, whereas the eccentricity of the bottom cover plate of the prior art sill may be of the order of ⅚ of the draft sill depth, the bottom cover plate eccentricity of the embodiment shown and described is less than ⅙ of the draft sill depth, probably less than 1/12 of the draft sill depth, and may be substantially nil.

As may be noted, longitudinally inboard of the truck center, to the extent that the top cover plate of the center sill is defined by the main deck floor sheet 129, and the height of main deck floor sheet 129 relative to Top of Rail decreases, the overall depth of center sill 30 between the top cover plate, i.e., the main deck sheet 129, and the bottom cover plate 122, also decreases. This is seen, for example, in the detailed view of FIG. 3*c*, where the end deck portion 130 immediately inboard of striker 35 is carried lower than draft sill top cover plate 132 in the region of bell mouth 36,(that height, or depth to the center sill bottom flange, being indicated at $h_{130}$) and longitudinally inboard to the location at which it merges with the draft sill cover plate at its downward tapered portion 133 longitudinally inboard of the draft gear (near frame 66),Inboard of the draft gear the floor elevation begins to decrease, as indicated in main deck first transition zone 134. In the embodiment illustrated, transition zone 134 runs from roughly the first lateral frame 66 adjacent to the rear draft stop to, or just past, the truck center. In the illustration shown, transition section 134 ends at an inboard web 136 of main bolster 70. Over the next adjacent portion 138, the deck sheet may be level, i.e., carried at a constant, or substantially constant, height (symbolized by local center sill depth $h_{138}$) from that point longitudinally inboard to a longitudinal station clear of the maximum excursion of the truck. This distance may be 3-½ to 5 feet beyond the truck center. The deck includes a second transition portion 140 adjacent to portion 138, that second transition portion 140 running for a modest distance of perhaps 1-3 feet inboard to the minimum height mid-span level portion 142 of main deck 50. The change in elevation may be 2-3 inches, or perhaps ⅙ to ¼ of the draft sill depth.

In contrast to the prior art center sill, in which the mid-span section is deeper than the draft sill portion, in center sill 30 the mid-span portion depth is not greater than the draft sill portion depth at the draft gear (i.e., immediately inboard of the striker), but, rather, may be the same as, or less than, that depth longitudinally inboard of the truck center, or, expressed differently, longitudinally inboard of the clearance limit of the truck. As may also be noted, and in contrast to the prior art fish-belly, the vertical depth of section $h_{142}$ of mid-span portion 40 (and, indeed, all of center sill 30) is less than the vertical overall depth of section $h_{42}$ of each side sill 42, 44. In the center of mid-span portion 40 the center sill depth is less than ⅗ of the side sill depth. For a car with truck centers of over 65 ft, this yields a center sill mid-span depth to truck center length aspect ratio of more than 1:85, and, in one embodiment more than 1:100.

As may also be noted, it follows that the bottom flange, or extremity, 94 of each cross-bearer (or cross-tie) of car 20 is carried level from the side sill to the center sill, at a height that is maintained as high or higher than the bottom cover plate 122 of center sill 30. This may be considered in contrast to the much deeper cross-bearer arms P88 and their bottom flanges P94 in the prior art underframe shown. This may also be expressed differently. In the prior art the cross-bearers deepen toward the center sill in the deeper, central portion of the car, as can be seen from the downward and inward slope of bottom flange P94 and the deepening section of the web of cross-bearer arm P88. By contrast, the outboard tip or end of bottom flange 94 of cross-bearer 88 terminates at side sill 42 (or 44, as may be) and continues inboard to center sill 30 at a level that is higher than the lowest extremity of side sill 42 (or 44), namely bottom flange 56.

In the example shown,

1. At the truck centers, for the center sill webs and bottom flange (i) the combined area of the center sill webs and bottom flange is about 20 sq. in.

(ii) the second moment of area in vertical bending is about 190 $in^4$.

(iii) the second moment of area in sideways bending is about 690 $in^4$.

(iv) the center sill depth is approximately 10-¼ inches.

2. At the truck centers, for the underframe in total (i) the combined area of the underframe is about 75-80 sq. in.

(ii) the second moment of area in vertical bending is about 1500-1600 $in^4$.

(iii) the second moment of area in sideways bending is about 100,000 $in^4$.

(iv) the overall section depth is about 16.5 inches (being that of the side sills).

3. At mid span, for the center sill webs and bottom flange (i) combined area of center sill webs and bottom flange is about 15-16 sq. in.

(ii) the second moment of area in vertical bending is about 70-80 $in^4$.

(iii) the second moment of area in sideways bending is about 470-480 $in^4$.

(iv) the center sill depth is approximately 8-⅛ inches.

4. At mid-span, for the underframe in total (i) the combined area of the underframe is about 70-75 sq. in.

(ii) the second moment of area in vertical bending is about 1240-1250 $in^4$.

(iii) the second moment of area in sideways bending is about 95,000 $in^4$.

(iv) the overall section depth is about 16.5 inches (being that of the side sills).

Figure 4A:
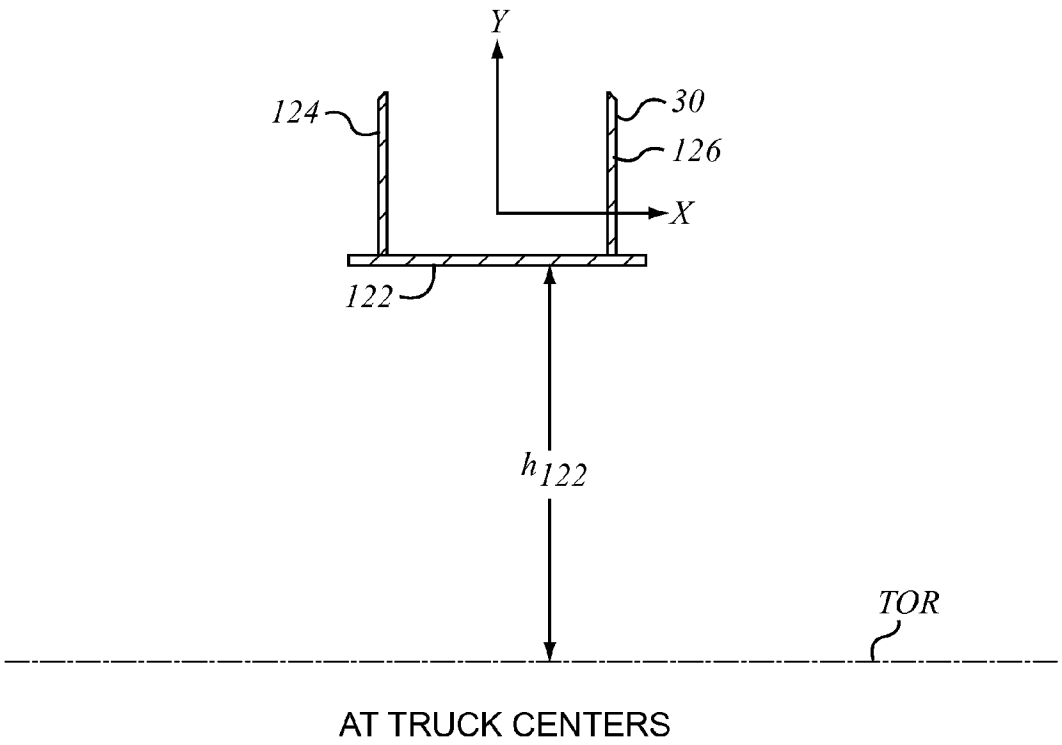
FIG. 4*a* shows bending resistance properties of the center sill of the underframe of FIG. 2*a* at the truck center.
Figure 4B:
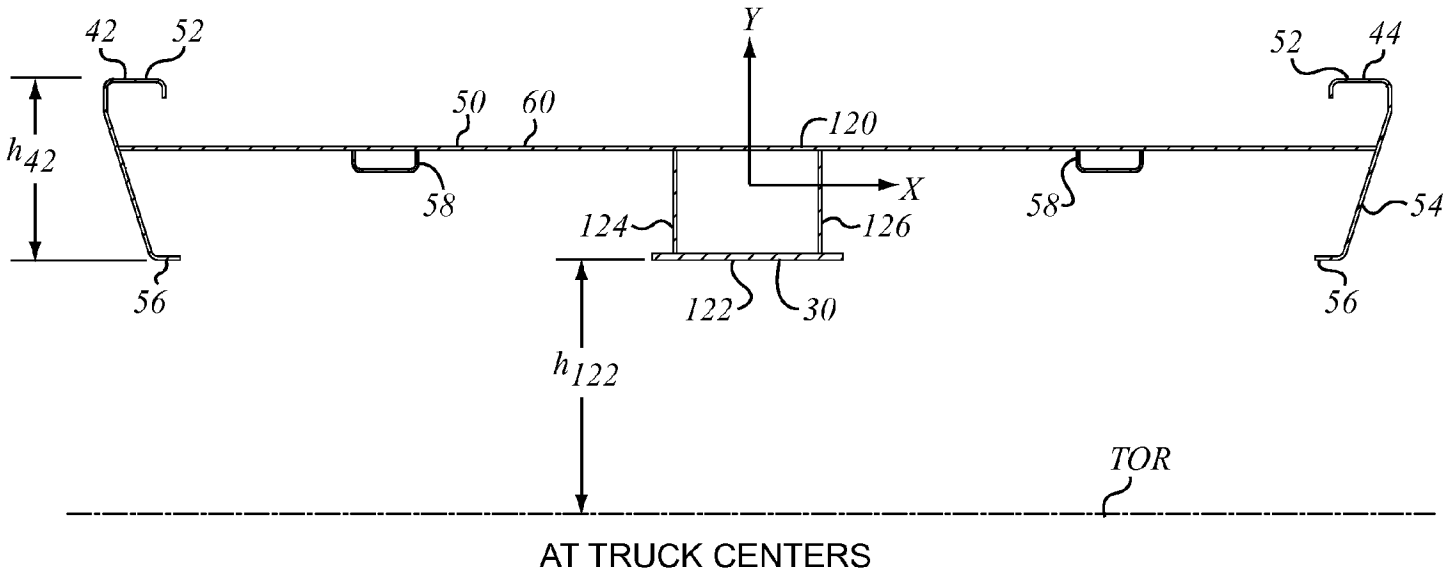
FIG. 4*b* shows bending resistance properties of the underframe of FIG. 2*a* at the truck center.
Figure 4C:
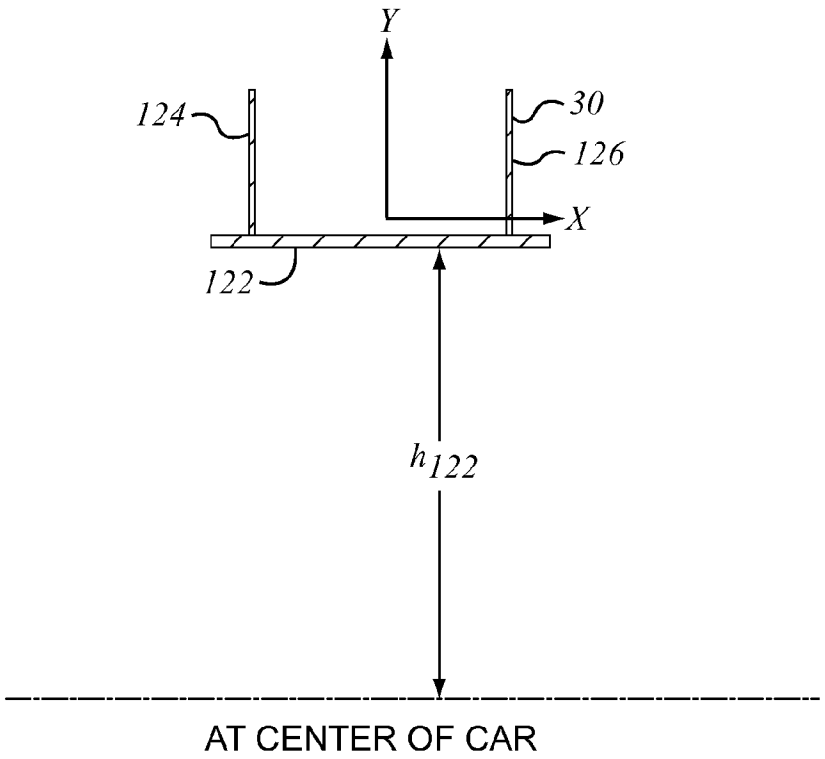
FIG. 4*c* shows bending resistance properties of the center sill of the underframe of FIG. 2*a* at mid-span.
Figure 4D:
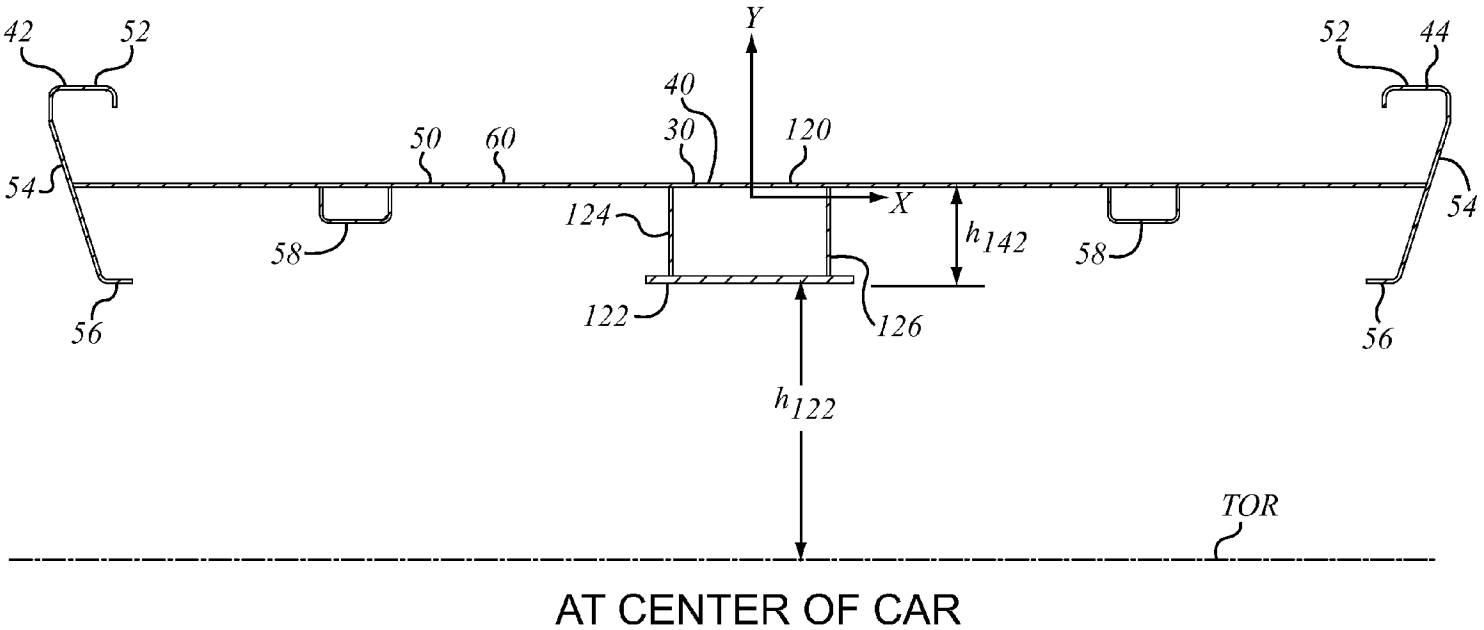
FIG. 4*d* shows bending resistance properties of the underframe of FIG. 2*a* at mid-span.
Figure 4E:
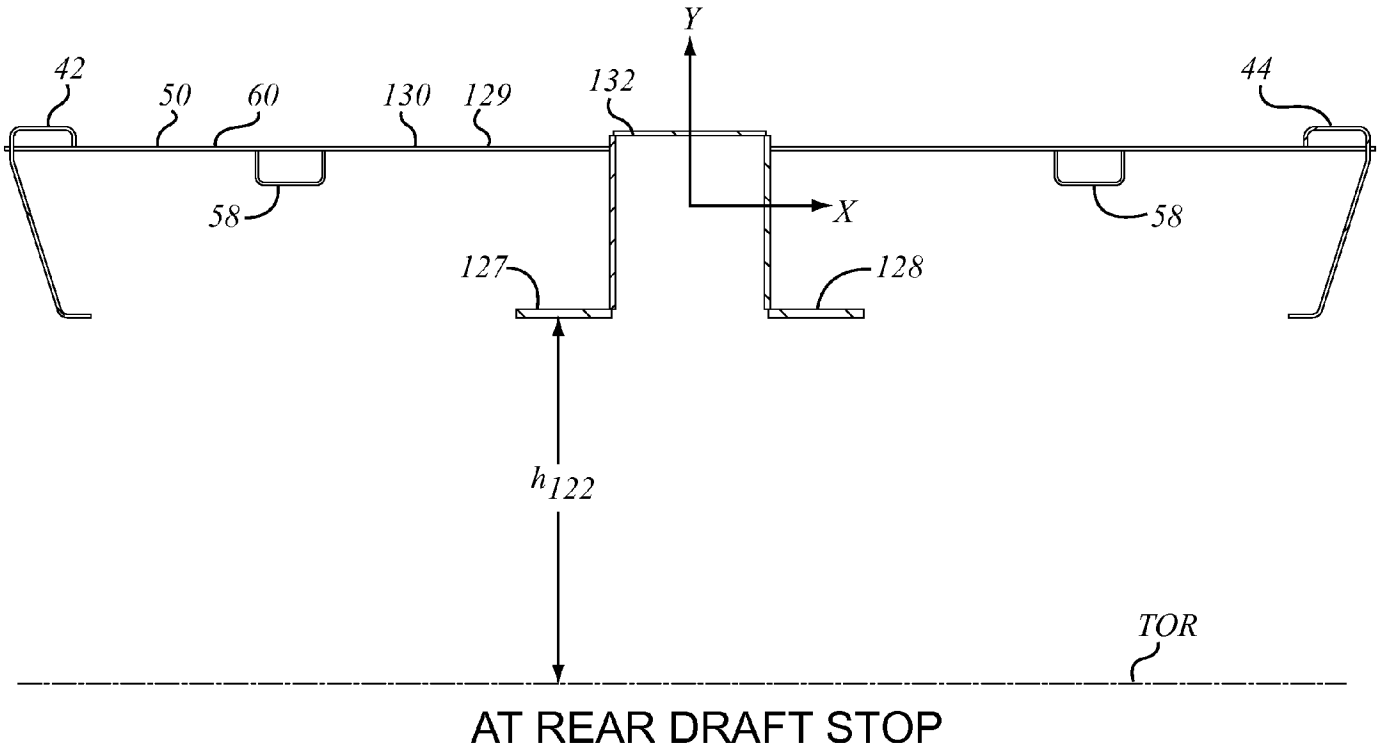
FIG. 4*e* is a draft sill section on '4*e*'-'4*e*' of FIG. 3*c*.
Figure 4F:
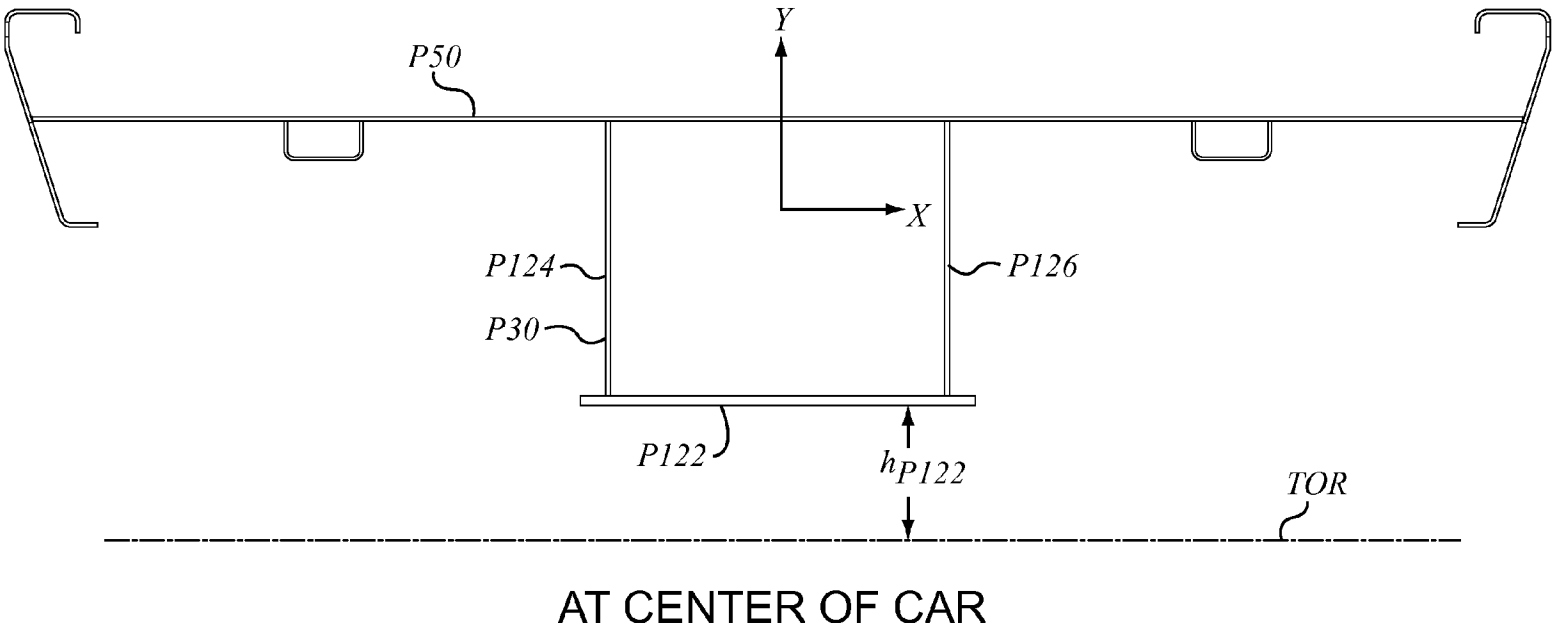
FIG. 4f (Prior Art)
FIG. 4*f* shows a cross-section of a prior art fish-belly center sill at mid-section.

In the prior art example of FIG. 4*f*, by contrast,

5. At mid-span, for the underframe in total (i) the combined area of the underframe is about 88-89 sq. in.

(ii) the area of the center sill flange and webs, alone, is about 30-35 sq. in.

(iii) the second moment of area in vertical bending is about 8000 $in^4$.

(iv) the second moment of area in sideways bending is about 98,000 $in^4$.

(v) the overall section depth is about 30-30 ½ inches.

The center sill properties at the longitudinal station of the rear draft stops, and shown in FIG. 4*e*, may be taken as a datum, and may be taken as being sufficiently similar to the prior art also to stand as a datum for prior art sectional properties at that longitudinal station. In the nomenclature used herein, the sectional properties of the center sill—depth of section, neutral axes, cross-sectional area, and second moment of area in flexure (i.e., moment of Inertia, I, and, correspondingly, flexural modulus EI, where E is the Young's modulus) are discussed on the basis of the bottom flange taken in combination with the center sill webs, and will be understood as such in contrast to the sectional properties (i.e., depth of section, neutral axes, cross-sectional area and second moment of area) of the car body underframe 22 at the corresponding section which are based on those same elements taken in combination with the side sills, center sill top cover plate (or top flange), deck sheeting, and stringers, such as may be. Reference to the area of the section is to the cross-sectional area of metal, proportionate to the weight of section per lineal foot (i.e., per running foot), rather than a measure of enclosed cross-sectional area. Taking for comparison the section in the middle of the car, as shown in FIGS. 4*c* and 4*d*, counting the cross-sectional area of the center sill webs, 124, 126 and the bottom cover plate or bottom flange 122, there is a cross-sectional reduction in area of the center sill of roughly ⅕ (i.e., the area at mid span is less than ⅘ of the datum cross-section), or more, from the datum draft sill area of FIG. 4*e*. In the prior art, as symbolized by the fish-belly center sill of FIG. 4*f*, the cross sectional area, depth, and second moment of area in resistance to vertical bending all increase from the datum to the center of the car. By contrast, in car 20, the sectional area, the depth of section, and the second moment of area all decrease when comparing the properties of the section at FIG. 4*f* with the section at FIGS. 4*c* and 4*d*. The properties at the mid-span longitudinal station of FIGS. 4*c* and 4*d* are also a decrease as compared to the properties at the truck center shown in FIGS. 4*a* and 4*b*. This reduction in section has a relatively small (less than 10%) effect on the $I_{xx}$ second moment of area of total overall change in resistance to vertical bending once the racks (i.e., including the top chords, posts, bracing, sheer panels and roof structure) have been installed.

As compared to the prior art fish belly, the reduction in center sill depth may be of the order of ⅖ or more in some embodiments, may be greater than half in other embodiments, and in some embodiments may be greater than ⅗.

As compared to the datum of FIG. 4*e*, the reduction in depth of the center sill may in some embodiments be greater than ⅓, (i.e., the center section depth if less than ⅔ of the draft sill section depth) in other embodiments may be greater than ⅖, (i.e., the center section minimum depth of section may be less than ⅗ of the draft sill depth of section) and in still other embodiments may be greater than ½. In one embodiment the reduction in depth of section may be as much as roughly ((17-7 ½)/17), i.e., roughly 55%.

Similarly, as compared to the datum of FIG. 4*e*, where the area of the draft sill webs and flange may be greater than 25 sq. in., the reduction in area to the mid-span location in some embodiments is greater than ⅕ (i.e., sectional area is less than ⅘ of datum area), may in some embodiments be greater than ¼ (i.e., sectional area is less than ¾ of datum area), may in other embodiments be greater than ⅓ (i.e., sectional area is less than ⅔ of datum area), and may in one embodiment be approximately as much as ⅜ (i.e., the remaining area is as little as ⅝ of the datum area).

Unlike the prior art, the depth of section of central portion 40 of center sill 30 of car 20 is less than the depth of section of the corresponding side sill at the same mid-span longitudinal station (e.g., the car central mid-section). Unlike the prior art fish-bellied car, the cross-bearers in the central portion of the car do not extend lower than the side sill bottom flange, and the flanges of those cross-bearers are carried substantially level with and flush with, the bottom cover plate of the center sill. The difference in second moment of area of the underframe section itself may be substantial. That is, as compared to the prior art datum of about 8000 $in^4$, the embodiment shown and described may have less than half the second moment of area, i.e., less than 4000 $in^4$. In one embodiment it is less than 2500 $in^4$, and may be about 1500-1600 $in^4$. This is not merely a quantitative change. Rather it is a qualitative change. In the prior art the center sill has a primacy of importance as the principle element of the underframe. In the car as shown and described, the reliance on the center sill is reduced as compared to the side sills, and greater reliance is placed on the housing superstructure. The underframe as described is manufactured, and the rack structure is mounted to the underframe subsequently, either at the location of fabrication of the underframe or at another location to which the underframe has been delivered. The underframe is not, by itself, intended to support the vertical loads of a fully-laded car.

When the replaceable rack structure of posts and braces and top chords is in place, the high longitudinal members act as chords of a truss more than 10 ft. distant from the side sills. This deep truss structure provides the car with the resistance to vertical bending required when carrying lading in service. As noted above, the underframe is intended to define, and to be, permanent structure of the autorack car, whereas the racks may have one third the life of the underframe. That is, the underframe may be provided with a first set of racks when new, and then with a further two sets of replacement racks during the lifetime of the car.

Although the description provided herein is made in the context of the single unit autorack car shown in FIG. 1*a*, it is also applicable to car unit bodies and underframes of individual body units of multiple-unit articulated autorack cars in which the top flange of the center sill cover plate, and the deck sheeting, descends to a diminished height in the middle of the car body, but is raised at the ends over the truck or trucks such as may be, while the bottom flange of the center sill is carried at a constant or substantially constant height without being kinked.

Further, although car 20 as shown is a tri-level car, (i.e., it has three lading-transporting decks, namely the main (or lower) deck, the middle deck and the top deck) it could also have the form of a bi-level car. It may be noted that a tri-level autorack car may employ a so-called low-profile truck with 28" diameter wheels and a reduced height center plate bowl. The height of the draft sill portion of the center sill is determined by the requirements for interchange service, namely that the center-line height of the coupler be 34 ½ inches above TOR for a new unladen car with new wheels. In a tri-level car the top flange of the draft sill is therefore higher than the adjacent end deck over which vehicles are loaded by roughly 2-4 inches. Further, in a tri-level car the height of the center sill top flange is reduced between the truck centers. Over that portion of the car, the top flange of the center sill may be defined by the main deck floor sheet.

In a bi-level car, (i.e., a car having a main deck and a single upper deck) the trucks may have the more common 33" diameter wheels, and may not be low-profile trucks. In those cars the end deck portion and the draft sill top flange may be carried flush with each other. Further, the top flange of the center sill may not have the dip, or depression, or reduction in height between the trucks found in the tri-level car. Rather the main deck, which may define the top flange of the center sill, may be carried at a constant, level (or substantially level) height from end to end of the car.

By making the center sill in the manner described, the center sill structure may be simplified, manufacture of that structure may be simplified, and the unladen weight of the car may be reduced. Any one of these things might be considered desirable. Given that the resistance to bending of the autorack car is greatly reduced unless a set of racks is in place, the underframe is not intended to carry lading or to operate in revenue service, without a set of racks installed.

Various embodiments have been described in detail. Since changes in and or additions to the above-described examples may be made without departing from the nature, spirit or scope of the invention, the invention is not to be limited to those details.

We claim:

1. An autorack railroad car comprising:

an underframe structure that includes a center sill, said center sill having a first end and a second end;

a first deck for transporting automotive vehicles, said first deck being supported by said center sill;

a first centerplate located closer to said first end of said center sill than to said second end thereof;

a second centerplate located closer to said second end of said center sill than to said first end thereof;

said first centerplate being seatable at a truck center of a first truck;

said second center plate being seatable at a truck center of a second truck;

said center sill running continuously from said first centerplate to said second centerplate;

said center sill having a first location, said first location being a mid-span location midway between said first and second center plates;

said center sill having a first depth of section at said mid-span location; and said center sill having a second depth of section at a second location away from mid-span location; and said second depth of section is greater than is said first depth of section.

2. The autorack railroad car of claim 1 wherein said center sill has a greater second moment of area in bending at said second location than at said first location.

3. The autorack railroad car of claim 1 wherein said center sill includes a draft sill portion, said second depth of section is measured at said draft sill portion; and said first depth of section is less than ⅔of said second depth of section.

4. The autorack railroad car of claim 1 wherein said center sill has a depth of section at said first location of not more than 12 inches.

5. The autorack railroad car of claim 1 wherein said center sill has a depth of section at said first location of not more than 8 inches.

6. The autorack railroad car of claim 1 wherein said center sill has a truck center distance of not less than sixty feet.

7. The autorack railroad car of claim 1 wherein:

said center sill has a top cover plate, a bottom flange, and at least one shear web extending therebetween;

at said first location said underframe has a second moment of area in vertical bending less than 4000 $in^4$;

at said first location said center sill has a second moment of area in vertical bending of less than 750 $in^4$;

and at least one of (a) when said car is unladen, said bottom flange is substantially flat and horizontal over substantially the entire distance between truck centers;

(b) said top flange at said first location is closer to TOR than at said second location; and (c) said at least one shear web is shallower at said first location than at said second location.

8. The autorack railroad car of claim 7 wherein said center sill satisfies all of (a), (b) and (c).

9. The autorack railroad car of claim 1 wherein said autorack railroad car has first and second side sills running along respective first and second laterally outboard margins of said first deck, said center sill has a top flange, a bottom flange, and first and second webs extending between said top flange and said bottom flange; and, at said first location at least one of:

(a) said first side sill has a greater depth of section than said center sill; and (b) said first side sill has a lower flange and an upper flange, and, at said first location, said bottom flange of said center sill is carried at a height that is at least as high as said lower flange of said first side sill.

10. The autorack railroad car of claim 1 wherein:

said car includes an housing running lengthwise along said car parallel to said center sill and overspanning said first deck, said housing having a first end and a second end, said housing having an accessway at one end thereof to permit the loading of vehicles;

said housing includes a pair of first and second top chords upwardly distant from said first deck;

said autorack railroad car includes shear connections between said top chords and said underframe.

11. The autorack railroad car of claim 1 wherein at said first location said center sill has a second moment of area in vertical bending of less than 750 $in^4$.

12. An autorack railroad car body unit underframe, said underframe comprising:

a lengthwise-running straight-through center sill running continuously from end to end of the car body unit;

said center sill having a first end and a second end;

said center sill having a mid-span location mid-way between said first end and said second end;

said center sill having a draft sill at said first end thereof;

said center sill having an end location at said draft sill;

said center sill having a top flange, a bottom flange, and at least one shear web member extending therebetween; and decking over which to conduct lading length-wise along said car body unit, said decking extending laterally to either side of said center sill;

said center sill having a depth of section, $h_m$, at said mid-span location;

said center sill having a depth of section, $h_d$, at said draft sill; and $h_m$is less than 20% greater than $h_d$.

13. The autorack railroad car body unit underframe of claim 12 wherein said top flange is carried at a lower height above TOR at said mid-span location than at said first end; and said bottom flange is substantially flat from end to end of said center sill.

14. The autorack railroad car of claim 12 wherein $h_m$ is less than $h_d$.

15. The autorack railroad car of claim 12 wherein said top flange is closer in height to said bottom flange at said mid-span location than at said first end, and, when said underframe is unladen, said bottom flange is no closer to TOR at said mid-span location than at said first end.

16. A center sill for an autorack railroad car, said center sill comprising:

a first end, a second end, and a medial portion between said first and second ends;

said center sill having a top cover plate, a bottom cover plate, and a pair of first and second laterally spaced apart webs extending between said top cover plate and said bottom cover plate, said top cover plate and said bottom cover plate defining respective top and bottom flanges of said center sill;

at least one of said first and second ends including a draft sill, said draft sill having a maximum depth of section, $h_d$, at a first longitudinal station of said center sill;

said medial portion having a minimum depth of section, $h_m$, at a second longitudinal station of said center sill distant from said first longitudinal station;

at said first longitudinal station said top cover plate being carried at a first height, $h_1$ relative to TOR;

at said second longitudinal station said top cover plate being carried at a second height, $h_2$, relative to TOR;

$h_1$ being at least as great as $h_2$; and $h_d$ being at least as great as $h_m$.

17. The center sill of claim 16 wherein said center sill has at a first truck center; at said first truck center said top cover plate is carried at a height, $h_{TC}$; $h_{TC}$ is greater than $h_m$; $h_d$ is greater than $h_{TC}$.

18. The center sill of claim 16 wherein said bottom cover plate of said center sill is free of slope discontinuities in elevation.

19. The center sill of claim 16 wherein said bottom cover plate is planar from end to end longitudinally.

20. The center sill of claim 16 wherein said bottom flange of said center sill is carried at a constant height, $h_{BF}$, throughout its length.

21. An autorack railroad car body, said car body having first and second ends, said car body comprising:

an underframe and a housing structure overspanning said underframe;

said housing structure including a longitudinally running array of posts mounted along lateral margins of said underframe, longitudinally running first and second top chords surmounting said posts, a roof structure extending upwardly of, and between, said first and second top chords, side wall panels mounted between pairs of said posts, said housing having at least a first end through which to permit lengthwise loading of vehicles;

said underframe including a center sill, and a pair of first and second side sills, said center sill and said side sills running lengthwise along said car body, said first side sill being spaced laterally to a first side of said center sill, said second side sill being spaced laterally to a second side of said center sill, said center sill being between said first and second side sills;

said underframe having decking upon which vehicles can be conducted lengthwise along said car body;

said decking extending between said center sill and said first side sill, and extending between said center sill and said second side sill;

said center sill including at least one draft sill portion adjacent one end of said car body, and a central portion, said central portion being located in a medial portion of said car away from said first end of said car body and away from said second end of said car body;

adjacent to said draft sill said decking being carried at a first height relative to TOR;

adjacent to said central portion of said center sill said decking being carried at a second height relative to TOR;

said first height being greater than said second height;

said center sill having a first depth of section at said draft sill;

said center sill having a second depth of section at said central portion thereof; and said second depth of section is less than said first depth of section.

* * * * *